US006189725B1

(12) United States Patent
Monico

(10) Patent No.: US 6,189,725 B1
(45) Date of Patent: Feb. 20, 2001

(54) PAINT CAN WITH RIM DRAINAGE APENTURES

(76) Inventor: Anthony Monico, 1565 W. Arrow Hwy., #E-1, Upland, CA (US) 91786

( * ) Notice: Under 35 U.S.C. 154(b), the term of this patent shall be extended for 0 days.

(21) Appl. No.: 09/166,641

(22) Filed: Oct. 5, 1998

Related U.S. Application Data

(63) Continuation-in-part of application No. 08/888,739, filed on Jul. 7, 1997.

(51) Int. Cl.[7] ..... B67D 1/16
(52) U.S. Cl. ..... 220/698
(58) Field of Search ..... 220/698, 699; 222/109, 522

(56) References Cited

U.S. PATENT DOCUMENTS

| | | | | |
|---|---|---|---|---|
| 1,696,240 | * | 12/1928 | Kircher, Jr. | 220/698 |
| 2,207,210 | * | 7/1940 | Von Knauf | 220/698 |
| 2,885,108 | * | 5/1959 | Donoghue | 220/698 |
| 5,160,067 | * | 11/1992 | Luber | 220/698 |

* cited by examiner

*Primary Examiner*—Joseph M. Moy

(57) ABSTRACT

A paint can with rim drainage apertures is provided wherein the paint can has a bottom face and a periphery integrally coupled thereto and extending upwardly therefrom for defining an interior space with an open top. The periphery has an annular lip integrally coupled thereto. The annular lip includes an annular groove formed in the top face thereof and at least one aperture in communication with both the annular groove and the interior space of the paint can.

1 Claim, 4 Drawing Sheets

FIG 5
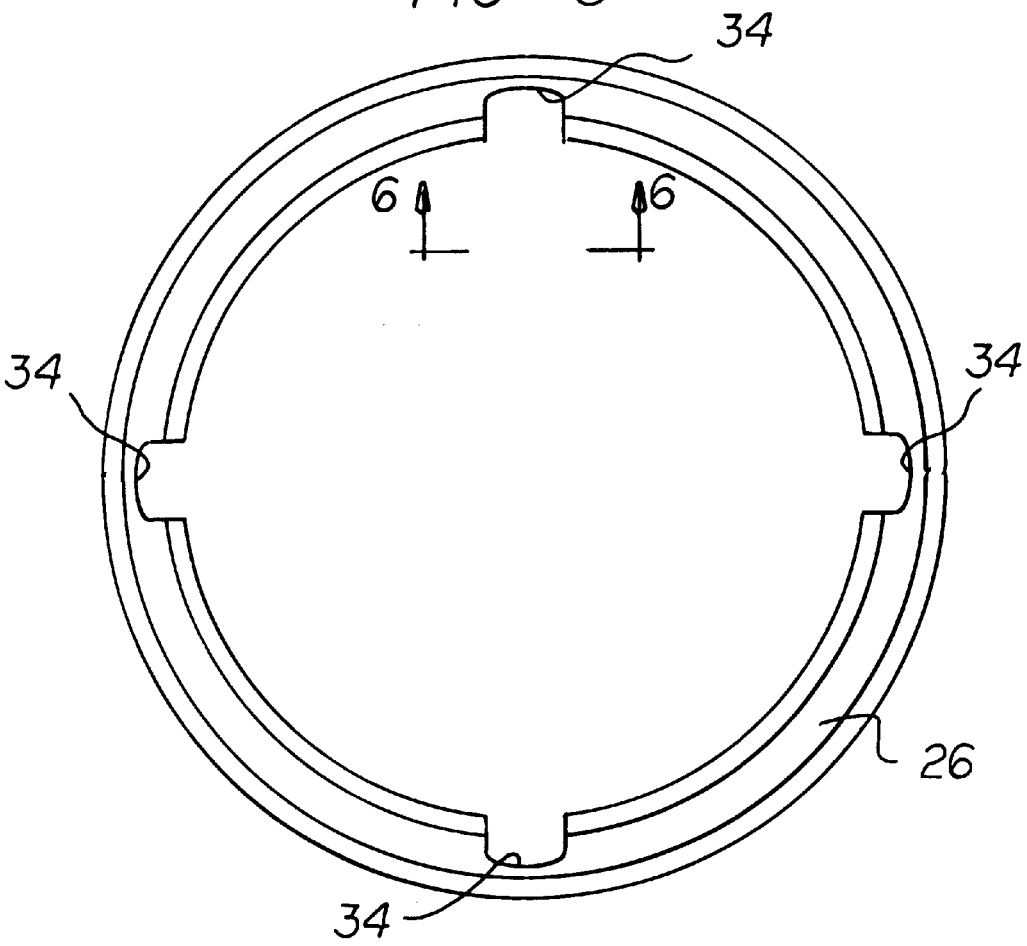
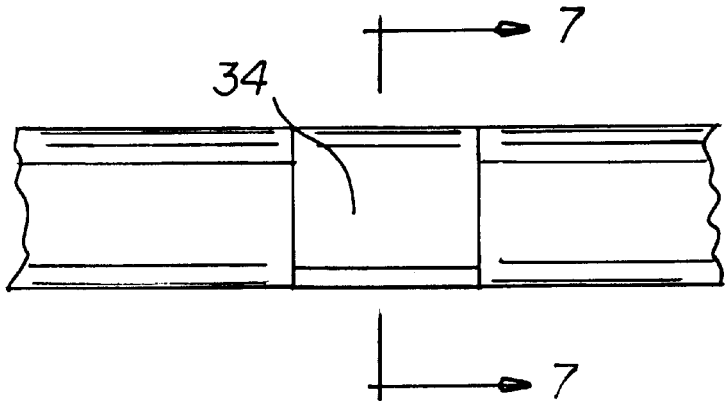
FIG 6

FIG 7
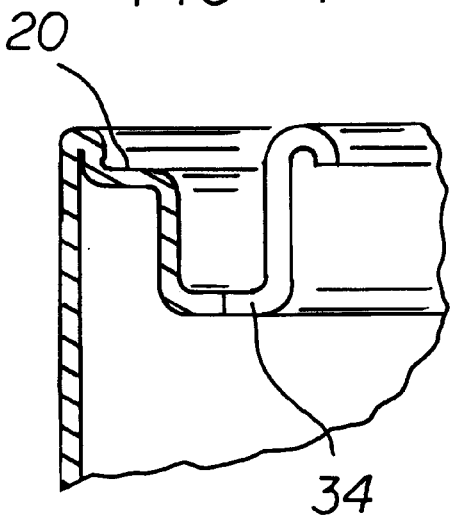
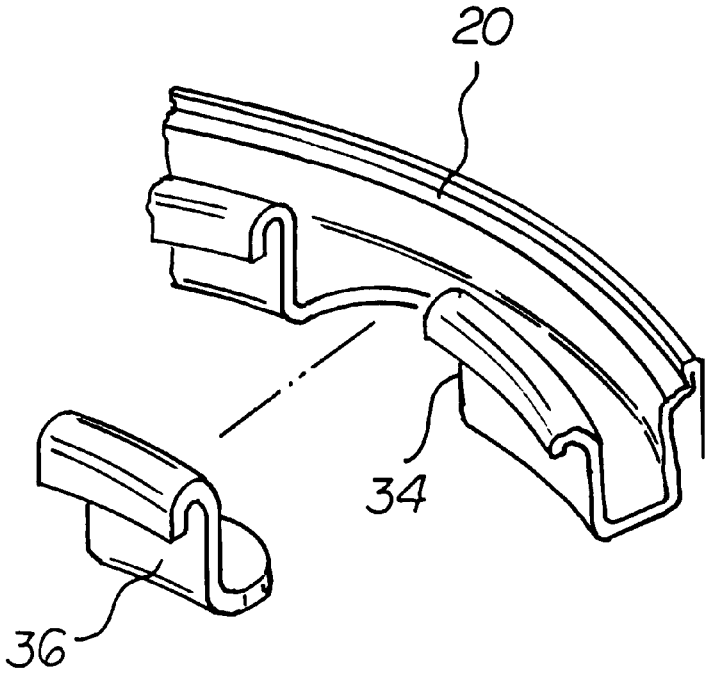
FIG 8

PAINT CAN WITH RIM DRAINAGE APENTURES

This application is a continuation-in-part of co-pending application Ser. No. 08/888,739 filed Jul. 7, 1997.

BACKGROUND OF THE INVENTION

1. Field of the Invention

The present invention relates to a paint can with rim drainage apertures and more particularly pertains to preventing paint from accumulating in a lid engaging annular groove of a paint can.

2. Description of the Prior Art

The use of paint cans is known in the prior art. More specifically, paint cans heretofore devised and utilized for the purpose of storing paint are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,512,494; U.S. Pat. No. 4,524,882; U.S. Pat. No. 5,212,869; U.S. Pat. No. 5,255,814; U.S. Pat. Des. 323,115; and U.S. Pat. No. 4,619,373.

In this respect, the paint can with rim drainage apertures according to the present invention substantially departs from the conventional concepts and designs of the prior art, and in so doing provides an apparatus primarily developed for the purpose of preventing paint from accumulating in a lid engaging annular groove of a paint can.

Therefore, it can be appreciated that there exists a continuing need for a new and improved paint can with rim drainage apertures which can be used for preventing paint from accumulating in a lid engaging annular groove of a paint can. In this regard, the present invention substantially fulfills this need.

SUMMARY OF THE INVENTION

In view of the foregoing disadvantages inherent in the known types of paint cans now present in the prior art, the present invention provides an improved paint can with rim drainage apertures. As such, the general purpose of the present invention, which will be described subsequently in greater detail, is to provide a new and improved paint can with rim drainage apertures which has all the advantages of the prior art and none of the disadvantages.

To attain this, the present invention essentially comprises a paint can. Such paint can has a cylindrical configuration with a circular bottom face and a cylindrical periphery integrally coupled thereto and extending upwardly therefrom. As such, an interior space with an open top is defined. It should be noted that the periphery has both an interior surface and an exterior surface. The interior surface of the periphery has an annular lip integrally coupled thereto. Such lip is extended radially inwardly from the periphery with a top face flush with the top of the can. For allowing the coupling of a lid thereto, the annular lip of the can has an annular groove formed in the top face thereof. For preventing paint from accumulating in the annular groove, a plurality of oval apertures are formed between a bottom surface of the annular lip and a bottom of the annular groove. By this structure, the paint is allowed to pass from the annular groove to the interior space of the can. This works to prevent splattering of the paint when the lid is attached.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint can with rim drainage apertures which has all the advantages of the prior art paint cans and none of the disadvantages.

It is another object of the present invention to provide a new and improved paint can with rim drainage apertures which may be easily and efficiently manufactured and marketed.

It is a further object of the present invention to provide a new and improved paint can with rim drainage apertures which is of a durable and reliable construction.

An even further object of the present invention is to provide a new and improved paint can with rim drainage apertures which is susceptible of a low cost of manufacture with regard to both materials and labor, and which accordingly is then susceptible of low prices of sale to the consuming public, thereby making such paint can with rim drainage apertures economically available to the buying public.

Still yet another object of the present invention is to provide a new and improved paint can with rim drainage apertures which provides in the apparatuses and methods of the prior art some of the advantages thereof, while simultaneously overcoming some of the disadvantages normally associated therewith.

Still another object of the present invention is to prevent paint from accumulating in a lid engaging annular groove of a paint can.

Lastly, it is an object of the present invention to provide a new and improved paint can which has a bottom face and a periphery integrally coupled thereto and extended upwardly therefrom for defining an interior space with an open top. The periphery has an annular lip integrally coupled thereto. The annular lip includes an annular groove formed in the top face thereof and at least one aperture in communication with both the annular groove and the interior space of the paint can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a plan view of an alternate embodiment of the present invention.

FIG. 6 is a side view of the present invention as taken along line 6—6 of FIG. 5.

FIG. 7 is a cross-sectional view of the present invention as taken along line 7—7 of FIG. 6.

FIG. 8 is a perspective view of an alternate embodiment of the present invention.

Similar reference characters refer to similar parts throughout the several views of the drawings.

DESCRIPTION OF THE PREFERRED EMBODIMENT

Figure 1:
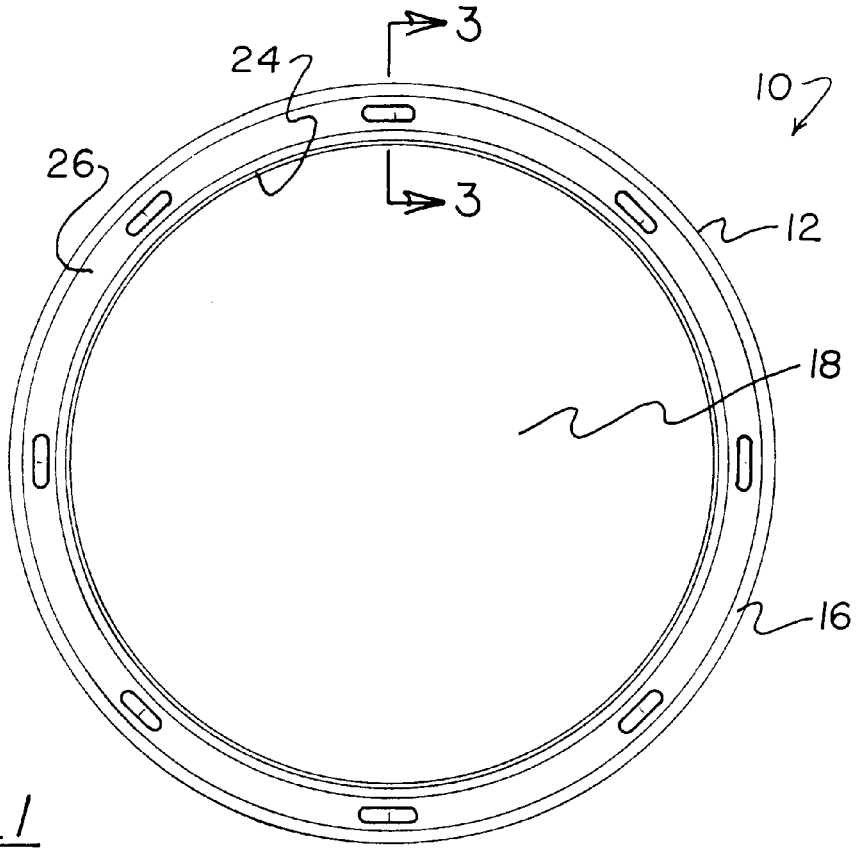
FIG. 1 is an illustration of the gallon size can of the present invention.
Figure 2:
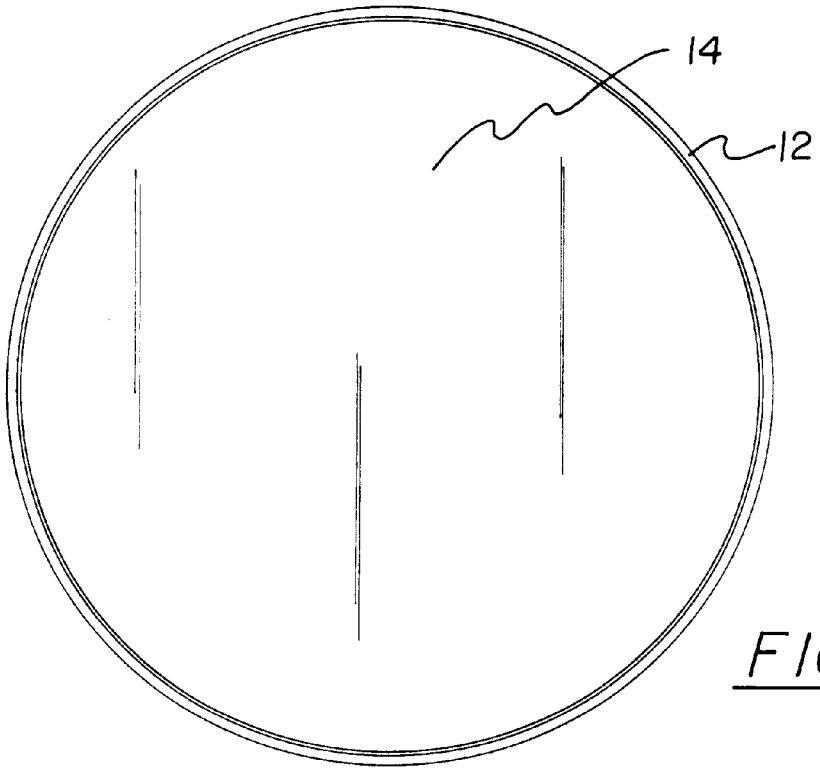
FIG. 2 is a bottom view of the paint can of the present invention.

With reference now to the drawings, and in particular to FIG. 1 thereof, a new and improved paint can with rim drainage apertures embodying the principles and concepts of the present invention and generally designated by the reference numeral 10 will be described.

The present invention, the new and improved paint can with rim drainage apertures, is comprised of a plurality of components. Such components in their broadest context include a plurality of apertures formed in a rim of a paint can. Such components are individually configured and correlated with respect to each other so as to attain the desired objective.

More specifically, it will be noted that the system 10 of the present invention includes a paint can 12. Such paint can has a cylindrical configuration with a circular bottom face 14 and a cylindrical periphery 16 integrally coupled thereto and extending upwardly therefrom. As such, an interior space 18 with an open top 20 is defined. It should be noted that the periphery has both an interior surface and an exterior surface.

Figure 3:
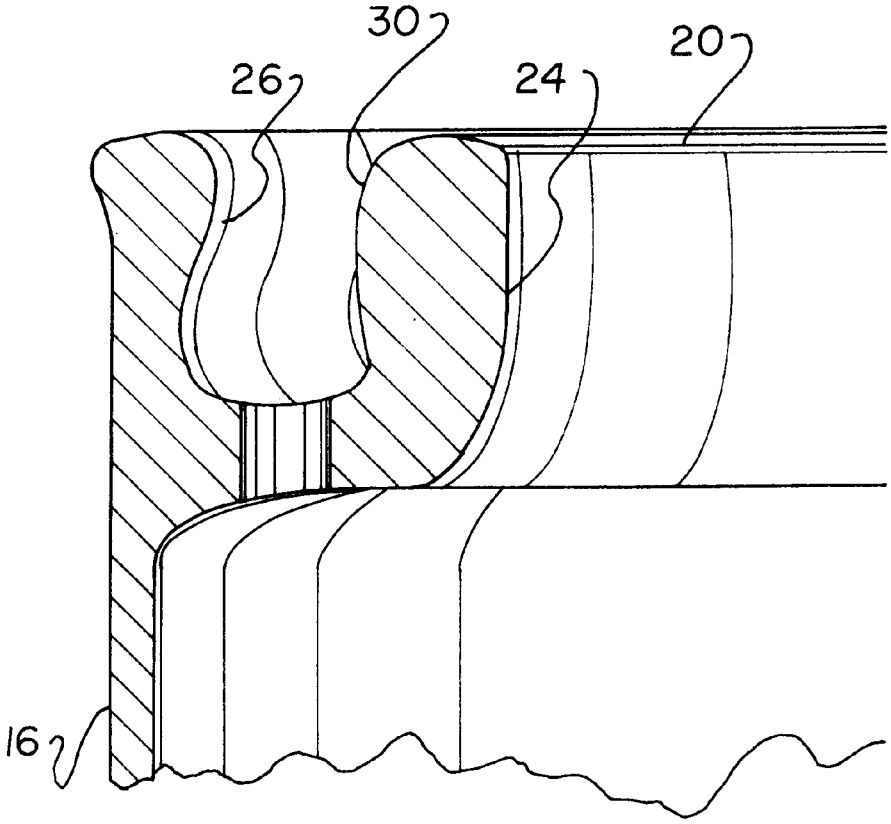
FIG. 3 is a cross-sectional view of the present invention taken along line 3—3 shown in FIG. 1.

The interior surface of the periphery has an annular lip 24 integrally coupled thereto. Such lip is extended radially inwardly from the periphery with a top face flush with the top of the can. For allowing the coupling of a lid thereto, the annular lip of the can has an annular groove 26 formed in the top face thereof. As shown in FIG. 3, the groove ideally has an inverted generally U-shaped cross-section with a pair of inwardly extending bulbous lips 30 extending inwardly toward a center of the groove. This feature will allow for the paint to be directed downwardly into the groove 26.

For preventing paint from accumulating in the annular groove, a plurality of generally rectangular or oval apertures 32 are formed between a bottom surface of the annular lip and a bottom of the annular groove. Such apertures each preferably have a width of about ¼ of an inch and a length at least 4 times the width. The area of the dimensions should, however, not exceed 5/32 by ⅜ of an inch. In the alternative, the aperture may simply be circular bores with a diameter of ¼ of an inch. It should be noted that the foregoing width or diameters are preferably greater than ⅛ of an inch.

By this structure, the paint is allowed to pass from the annular groove to the interior space of the can. This works to prevent splattering of the paint when the lid is attached. In addition, paint is thus prevented from drying within the groove thereby facilitating the removal of the lid with ease.

Figure 4:
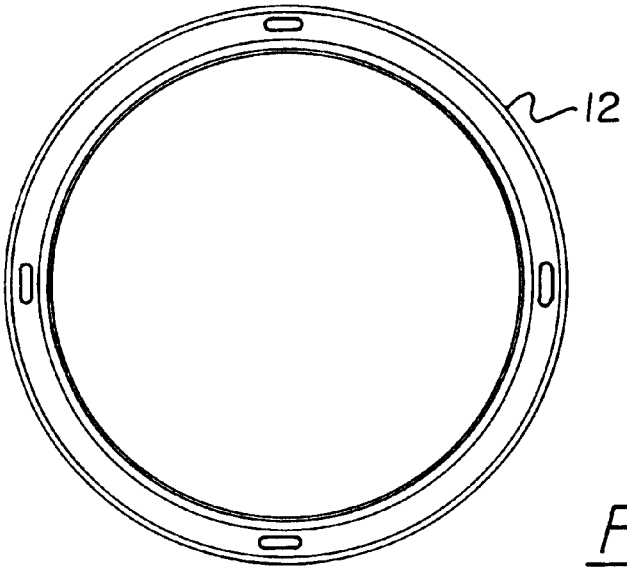
FIG. 4 is an illustration of the quart size can of the present invention.

In the first embodiment, the interior space of the can has a volume of 1 gallon. Commensurate with such size, the quantity of equally spaced apertures is eight. Note FIG. 1. In a second embodiment, the can has a volume of 1 quart and included are 6 equally spaced apertures, as shown in FIG. 4.

A third embodiment of the present invention is illustrated in FIGS. 5–7. In the third embodiment, the apertures are replaced by a plurality of slots 34 extending inwardly of the forward edge and the bottom edge of the lip. In this embodiment, the preferred number of slots 34 are four in number. The four slots 34 are disposed at ninety degree intervals around the paint can 12.

A fourth embodiment of the present invention is illustrated in FIG. 8. In the fourth embodiment, the four slots 34 each include cut-outs 36 removably disposed therein. Thus, the slots 34 will not be exposed until the user removes the cut-outs 36 once the painting process has begun and paint will start accumulating within the groove 26. Thus, the slots 34 will not be exposed until the user determines that they need to use them. The cut-outs 36 will be dimensioned to exactly conform with the shape of the lip.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A can with rim drainage apertures comprising a can with a bottom face and a periphery integrally coupled thereto and extending upwardly therefrom for defining an interior space with an open top, the periphery having a lip integrally coupled thereto, the lip having a groove formed in the top face thereof with a vertical interior component and a vertical exterior component and a lower horizontal component therebetween and four slots disposed at ninety degree intervals around the paint can, each slot solely formed in a portion of the vertical interior component and the lower horizontal component in communication with both the groove and the interior space of the can, and in spacing relationship with said vertical exterior component.

* * * * *